US005129851A

United States Patent [19]

Villanueva

[11] Patent Number: 5,129,851

[45] Date of Patent: Jul. 14, 1992

[54] TOY CONVERTIBLE BETWEEN A TOY VEHICLE AND A FINGER RING

[75] Inventor: Angelo Villanueva, Clementon, N.J.

[73] Assignee: Lee N. Tran, Galloway Township, N.J. ; a part interest

[21] Appl. No.: 767,150

[22] Filed: Sep. 30, 1991

[51] Int. Cl.[5] ..... A63H 17/00; A44C 9/00

[52] U.S. Cl. ..... 446/26; 446/466; 446/469; 63/15

[58] Field of Search ..... 446/26, 465, 466, 469, 446/470, 487; 63/15, 15.7

[56] References Cited

U.S. PATENT DOCUMENTS 4,413,443 11/1983 Kulesza et al. ..... 446/26
4,822,316 4/1989 Shaffer et al. ..... 446/466
4,850,929 7/1989 Genevey ..... 446/466

*Primary Examiner*—Mickey Yu
*Attorney, Agent, or Firm*—Norman E. Lehrer

[57] ABSTRACT

A toy for amusement purposes which is convertible between a toy vehicle and a finger ring. As a vehicle, the toy has rotatable wheels for rolling the vehicle on a surface. When the toy is re-configured as a ring, it becomes a ring for a finger with an ornament. The toy is comprised of a body member and two extending members pivotally attached to the body member. As a vehicle, one extension member extends forward relative to the body member and the other extends rearward thereby representing the hood, cab, and trunk sections of the vehicle. The second of the two extending members is also slidably attached to the body member. Both extending members have wheel assemblies attached to the end thereof opposite the end attached to the body member. The body member is oval in shape and ornamental in appearance. The pivotal and slidable attachments allow the extending members to be moved arcuately, relative to the body member for changing between a toy vehicle and a ring. As a ring, the extension members form an enclosure to be fit around the finger such that the extensions extend perpendicular to the body and parallel to each other. The enclosure size can be adjusted via the slidable attachment of the second member until a snug fit on the finger is established. The toy, whether worn as a ring or used as a vehicle, has tight fits between the respective pivotal and slidable attachments which function to secure the toy in the chosen shape or size until re-configured into a new shape or size.

9 Claims, 1 Drawing Sheet

TOY CONVERTIBLE BETWEEN A TOY VEHICLE AND A FINGER RING

BACKGROUND OF THE INVENTION

The present invention is directed toward a toy and more particularly toward a toy which is convertible between a toy wheeled vehicle and a finger ring.

Convertible toys, that is, toys that are capable of changing their configurations from one class or type of article to another have the advantage of providing to a person alternative forms of entertainment in one package. Instead of buying two or more toys, each having a unique entertainment value, the consumer need only purchase one convertible toy which serves several purposes. An additional benefit from these toys is that much of the fun experienced from a convertible toy and the entertainment it provides, emerges from its mere convertible nature.

There are many forms of convertible toys on the market which convert primarily from one kind of toy to another. For example, the "transformer" type toys are convertible toys which convert from a superhero to a spaceship or the like. These toys, while changing forms, remain in the same general categorical description as the toy from which it changed.

SUMMARY OF THE INVENTION

The invention in the present application is a toy which can be used as a toy vehicle for rolling along a surface or can be converted into a ring to be worn on a finger via its moving parts. The toy also has means for adjusting its size and changing its shape while in either configuration.

In accordance with the invention, the toy comprises a body member, and two extension members which are pivotally attached to the body member. The extension members have wheel and axle assemblies attached to their free end. The body member is substantially oval-shaped and has an ornamental appearance representing either the cab section of the car or the ornament of the ring. The extension members act as the hood and trunk sections of a car or the enclosure portion of a ring. Each extension member moves arcuately relative to the body member and towards each other to form the enclosure through which the finger slides. The second extending member is also slidably attached to the body member for adjusting the size of the ring for different fingers and for adjusting the length of the vehicle. In the vehicle configuration, one extension member extends rearwardly relative the body member and the other extends forwardly relative the body member. In the ring configuration, the extension members extend perpendicular to the body member and parallel to each other. The extending members have a tight fit with the body member via pins such that when a shape or size is chosen, either as a vehicle or a ring, the toy will stay in that shape until it is re-configured.

The instant invention has the unique nature of being convertible between objects of dissimilar character. While most convertible toys remain in the same general category of the form from which they were converted, the instant invention involves a toy vehicle and a ring. This unique combination provides greater entertainment value than the average convertible toy, for it provides distinctive forms of amusement. The instant convertible toy will prolong or possibly avoid the inevitable fate of other toys that quickly find their home in the back of the closet.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
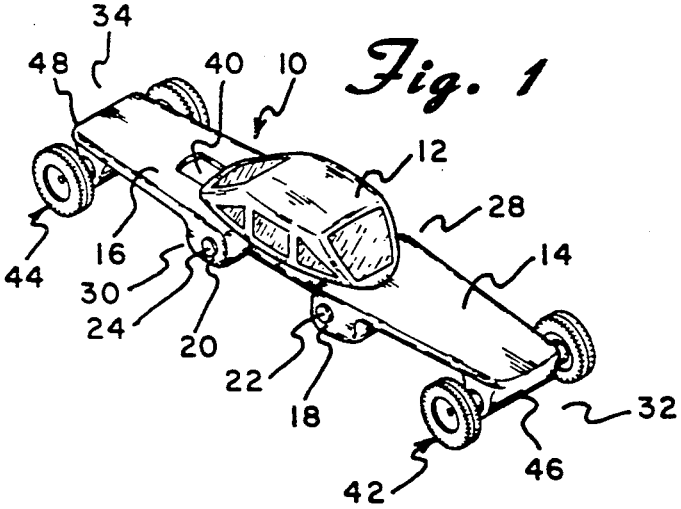
FIG. 1 is a perspective view of the convertible toy constructed in accordance with the principles of the present invention in its vehicle configuration.

Referring now to the drawings in detail wherein like reference numerals have been used throughout the various figures to designate like elements, there is shown in FIG. 1 a perspective view of the convertible toy constructed in accordance with the principles of the present invention and designated generally as 10.

The convertible toy 10 is comprised of a body member 12, a first extension member 14, and a second extension member 16. The extension members 14 and 16 are each pivotally attached to the body member at 18 and 20, respectively, via pins 22 and 24.

Figure 2:
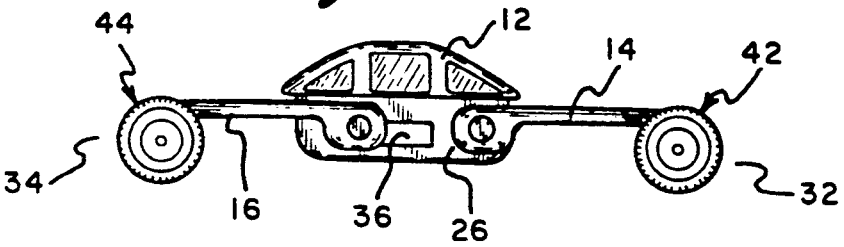
FIG. 2 is a side view of the convertible toy in its vehicle configuration.

Referring to FIGS. 1 and 2, the body member 12 is substantially oval-shaped from a top view and shaped similar to the passenger section of a car from the side view (FIG. 2). The body member 12 has a vertically extending and substantially perpendicular extension or ridge 26 on its underside to which the first and second extension members attach. Extension members 14 and 16 each have a secured end 28 and 30, attached to the ridge 26, respectively, and a free end 32 and 34, respectively. Each secured end 28 and 30 has a spaced apart, dual section raised hub 33 and 35 on the underside thereof through which the pins 22 and 24 are fitted through holes therein. The perpendicular ridge 26 has a hole on one end to fit the first extending member 14 and its pin 22. The perpendicular ridge 26 has an elongated slot 36 shown best in FIG. 2, through which the pin on the second extension member 16 fits.

The first extension member 14 has a relief 38 starting at its secured end extending towards the free end 32. The relief is substantially rectangular in shape and slightly larger in width than the width of the ridge 26. The relief 38 provides clearance to allow arcuate motion of the extension member 14 relative and along the perpendicular ridge 26. Similarly, the second extension member 16 has a similarly shaped relief for the same purpose. However, the second relief 40 is longer and extends farther towards the free end 34. The slot 36 permits the pin 24 and extension member 16 to move along the ridge 26 towards the center of the body member 12. A longer relief 40 is needed to allow this interaction and movement relative to the body member 12 especially while the toy 10 is in the vehicle configuration (FIG. 2). Each extension member 14 and 16 has a wheel assembly 42 and 44, respectively, attached to the free ends 32 and 34. The axles of the wheel assemblies 42 and 44 fit through hubs 46 and 48 that extend the width of the free ends 32 and 34 at each free end.

In the vehicle configuration (FIGS. 1 and 2), the first extension member 14 extends forwardly relative to the body member 12 and represents the hood section of the car. The second extension member 16 extends rearwardly relative to the body member 12 and represents the trunk section of the car. The body member 12 represents the cab section or passenger-carrying section of the car. The extension members 14 and 16 are on a horizontal plane with the body member 12 in the car configuration.

Figure 3:
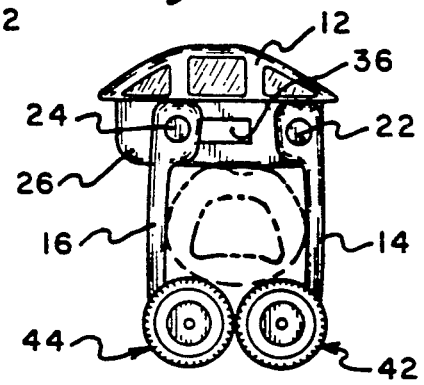
FIG. 3 is a front view of the convertible toy in its ring configuration as worn on the finger.
Figure 4:
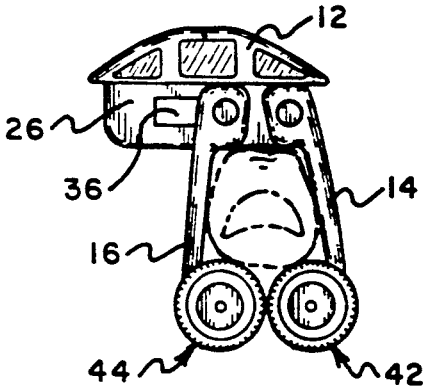
FIG. 4 is a front view of the convertible toy in its ring configuration as worn on the finger which also illustrates the adjustment feature of the invention.
Figure 5:
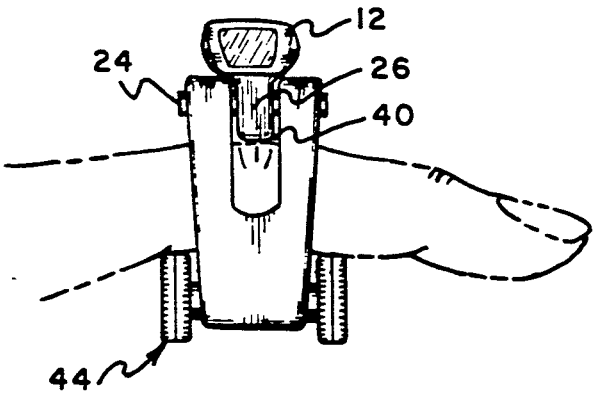
FIG. 5 is a side view of the convertible toy in the ring configuration as worn on the finger.

In the ring configuration, shown in FIGS. 3, 4 and 5, the extension members 14 and 16 extend substantially perpendicularly to the body member 12 and parallel to each other. The extension members 14 and 16 form the sides of the ring and the wheel assemblies 42 and 44 form the bottom of the ring. The ridge 26 of the body member 12 forms the top portion of the ring while the body member 12 represents an ornament.

In either configuration, FIG. 2 or FIG. 3, the vehicle or the ring, the toy remains in the chosen shape until it is re-configured. The fits between the pins 22 and 24 and the hole and slot through the ridge 26 and the fit between the relief areas 38 and 40 and the ridge 26 are such to accomplish and maintain secured shapes and sizes. The fits are essentially interference fits between the interconnected parts requiring force to overcome the friction holding the parts at their respective relative positions. The wheels of the wheel assemblies 42 and 44 attached to the free ends 32 and 34 of the extension members 14 and 16, respectively, are shaped such that they interlock while the toy 10 is in the ring configuration. In cooperation with the interference fits, this feature provides additional security for maintaining the ring on the finger and holding the chosen size and shape.

While the vehicle is in the car configuration, FIGS. 1 and 2, it is used as follows. The toy vehicle is placed on a surface and can be formed into various styles. These styles include an elevated hood style, an elevated trunk style, and also different length vehicle styles. The toy 10 will remain in these styles due to the fits discussed until it is re-configured. The length can be changed via the slot 36 and the slidable attachment of the second extension member 16 to the ridge 26. After the desired configuration is chosen, the toy vehicle is rolled across a substantially smooth surface.

While in the ring configuration, FIGS. 3, 4 and 5, the toy is used as follows. The finger is placed between the extension members 14 and 16. The extension members are pushed together onto the finger using the pivotal attachments at 18 and 20 until the wheel assemblies 42 and 44 interlock. The size of the ring is then further adjusted, as shown in FIG. 4, by sliding the extension member 16 inward towards the finger until a secure and snug fit is established.

The present invention may be embodied in other specific forms without departing from the spirit or essential attributes thereof and accordingly reference should be made to the appended claims rather than to the foregoing specification as indicating the scope of the invention.

What is claimed is:

1. A toy for amusement purposes which is convertible from a toy vehicle into a finger ring and back into a vehicle, comprising a body member, a first extension member extending forwardly of said body member and a second extension member extending rearwardly of said body member, each of said extension members being pivoted to said body member at a secured end and being movable between a first position wherein they are in substantial alignment with said body member and each other and a second position wherein they are spaced apart but substantially parallel to each other and substantially perpendicular to said body member, and further comprising adjustment means for changing the size and shape of said toy while said toy is in either the vehicle configuration or the finger ring configuration, said adjustment means comprising one of said extension members, in addition to being pivotally attached, also being slidably attached to said body member.

2. The invention according to claim 1 wherein said extension members form sides and a bottom of said ring and said body member forms a top portion of said ring and an ornament for said ring.

3. The invention according to claim 2 wherein said first extension member represents a hood section of said toy vehicle, said second extension member represents a trunk section of said toy vehicle, and said body member represents a cab section of said toy vehicle.

4. The invention according to claim 3 wherein said body member includes a perpendicularly extending ridge on its underside which extends for substantially the entire length of said body member, said ridge having a hole for pivotal attachment of said first extension member and having a slot for pivotal and slidable attachment of said second extension member.

5. The invention according to claim 4 wherein said first extension member and said second extension member are each comprised of an elongated flat member having two spaced apart hubs at said secured end, said hubs having aligned holes therethrough for harboring a pin for pivotal attachment of said secured ends to said perpendicular ridge, said first extending member having a relief slot extending lengthwise through said secured end between said hubs and towards an opposite end to permit clearance for its arcuate movement relative to said perpendicular ridge, said second extending member having a larger relief slot extending lengthwise through said secured end between said hubs and towards an opposite end to permit clearance for its arcuate movement, from different locations along said slot, relative to said perpendicular ridge.

6. The invention according to claim 5 wherein said first extension member and said second extension member each include a wheel and axle assembly attached to an end thereof opposite said secured end.

7. The invention according to claim 6 wherein the wheels of each wheel assembly rotate such that said vehicle can be rolled on its wheels along a surface.

8. The invention according to claim 4 wherein said pivotal and slidable attachments of said extension members to said body member have tight fits such that when said toy is configured into a chosen shape or chosen size, said toy will remain in that shape or size until re-configured.

9. The invention according to claim 7 wherein said wheel assemblies of each extension member interconnect with each other to effectively hold said ends opposite said secured ends of said extending members together while said toy is in said ring configuration.

* * * * *